US010982475B2

(12) United States Patent
Iwata

(10) Patent No.: US 10,982,475 B2
(45) Date of Patent: Apr. 20, 2021

(54) HINGE

(71) Applicant: Sugatsune Kogyo Co., Ltd., Tokyo (JP)

(72) Inventor: Shinpei Iwata, Tokyo (JP)

(73) Assignee: SUGATSUNE KOGYO CO., LTD., Tokyo (JP)

( * ) Notice: Subject to any disclaimer, the term of this patent is extended or adjusted under 35 U.S.C. 154(b) by 0 days.

(21) Appl. No.: 16/494,250

(22) PCT Filed: Feb. 7, 2018

(86) PCT No.: PCT/JP2018/004236
§ 371 (c)(1),
(2) Date: Sep. 13, 2019

(87) PCT Pub. No.: WO2018/168267
PCT Pub. Date: Sep. 20, 2018

(65) Prior Publication Data

US 2020/0131819 A1 Apr. 30, 2020

(30) Foreign Application Priority Data

Mar. 16, 2017 (JP) ..... JP2017-050968

(51) Int. Cl.
*E05D 5/02* (2006.01)
*E05D 7/04* (2006.01)
*E05D 7/081* (2006.01)

(52) U.S. Cl.
CPC ..... *E05D 7/04* (2013.01); *E05D 7/081* (2013.01)

(58) Field of Classification Search
CPC ..... E05D 7/04; E05D 7/0415; E05D 7/081; E05D 5/0246; E05D 2007/0484; E05Y 2900/132; Y10T 16/534; Y10T 16/552
See application file for complete search history.

(56) References Cited

U.S. PATENT DOCUMENTS 2,530,331 A * 11/1950 Hubbs ..... E05D 7/081 16/245
3,152,355 A 10/1964 Ferguson
(Continued)

FOREIGN PATENT DOCUMENTS

CA 877607 A 8/1971
GB 824689 A * 12/1959 ..... E05D 7/0423
(Continued)

OTHER PUBLICATIONS

WIPO, Japanese International Search Authority, International Search Report (with English translation) and Written Opinion dated Mar. 13, 2018 in International Patent Application No. PCT/JP2018/004236, 7 pages.
(Continued)

*Primary Examiner* — Chuck Y Mah
(74) *Attorney, Agent, or Firm* — Masuvalley & Partners

(57) ABSTRACT

An object is to provide a hinge capable of preventing an unintentional shift in height to an up-and-down direction with respect to rotation of a door.
A hinge comprises a holder part supporting rotatably a door and for holding the door, a supporting part and for rotatably supporting the holder part from below, a rotation part having a screw on an inner circumference for rotatably connecting to the screw thread of the rotation part, a first regulation part disposed to the holder part and for regulating rotation of the rotation shaft with respect to the supporting part, and a second regulating part disposed to the holder part and for regulating up-and-down movement of the adjustment ring with respect to the holding part along an upper-and-lower direction.

6 Claims, 9 Drawing Sheets

(56) References Cited

U.S. PATENT DOCUMENTS 3,325,942 A * 6/1967 Bejarano ..... E05D 7/0423 49/381
3,555,733 A * 1/1971 Horgan, Jr. ..... E05D 7/0423 49/388
3,592,257 A 7/1971 Matyas
3,662,493 A * 5/1972 Foltz ..... E05D 7/081 49/388
4,209,946 A * 7/1980 Akai ..... E05D 7/0423 16/245
4,523,414 A * 6/1985 Horgan, Jr. ..... E05D 5/0246 49/388
4,646,472 A * 3/1987 Sugawara ..... E05F 1/123 16/238
4,977,642 A * 12/1990 Marinoni ..... E05D 5/0246 16/257
5,054,163 A 10/1991 Sterling et al.
5,483,770 A * 1/1996 Marinoni ..... E05D 7/0423 16/229
5,548,869 A * 8/1996 Ryczek ..... E05D 7/0018 16/235
5,694,665 A * 12/1997 Strickland ..... E05D 7/0423 16/237
5,713,105 A * 2/1998 Toomey ..... E05D 7/0423 16/238
9,447,579 B2 * 9/2016 Kopish ..... E04B 2/74
10,330,370 B2 * 6/2019 Choi ..... F25D 23/02
2011/0001413 A1 * 1/2011 Park ..... F25D 23/028 312/405

FOREIGN PATENT DOCUMENTS

JP S5978472 U 5/1984
JP H6-20863 Y2 6/1994
JP H6-45023 Y2 11/1994
JP 2008-121342 A 5/2008
JP 4331669 B2 9/2009
JP 4805098 B2 11/2011
KR 100329621 B1 * 3/2002 ..... E05D 7/0423
WO WO-2018126567 A1 * 7/2018 ..... F25D 23/028

OTHER PUBLICATIONS

EPO, Supplementary European Search Report dated Dec. 14,2020 in European Application No. EP18767246.4, 8 pages.

* cited by examiner

HINGE

RELATED APPLICATIONS

This application is the U.S. National Phase of and claims priority to International Patent Application No. PCT/JP2018/004236, International Filing Date Feb. 7, 2018, entitled Hinge; which claims benefit of Japanese Application No. 2017/050968 filed Mar. 16, 2017; both of which are incorporated herein by reference in their entireties.

TECHNICAL FIELD

The present invention relates to a hinge for rotatably supporting a door.

BACKGROUND ART

Conventionally, a hinge for rotatably supporting a door is known. A support shaft (lower pivot) of the hinge is screwed into a female screw cylinder disposed to a holder part (fixing plate) for holding the door. The supporting shaft (lower pivot) protrudes downwardly from the female screw cylinder. By rotating a rotation part (flange part for height adjustment) disposed integrally with the support shaft (lower pivot), a length of a part of the supporting shaft protruding beyond the female screw cylinder can be changed so as to adjust a height of the door (for example, refer to Patent Literature 1).

CITATION LIST

Patent Literature

Patent Literature 1: Japanese Utility Model Unexamined Publication No. 59-78472.

SUMMARY OF INVENTION

Problem to be Solved by Invention

In a configuration described in Patent Literature 1, when tying to move the holder part (fixture plate) for holding the door up-and-down by rotating the rotation part (flange part for height adjustment), the supporting shaft (lower pivot) rotates together. Therefore, in such configuration, there is a fear that the height of the door shifts unintendedly to an up-and-down direction when the door is made to rotate upon opening and closing.

An object of the present invention is to provide a hinge for preventing an unintentional shift of the door in the up-and-down direction upon rotating the door.

Solution to Problem

A hinge of the present invention for achieving the above object comprises; a holder part for holding the door; a supporting part having a screw on an outer circumference and for supporting rotatably the holder part from below; a rotation part having a screw on an inner circumference and for rotatably connecting to the screw of the supporting part; a first regulation part disposed to the holder part and for regulating rotation of the supporting part with respect to the holder part; and a second regulation part disposed to the holder part and for regulating movement of the rotation part in an up-and-down direction with respect to the holder part.

Advantageous Effects of Invention

According to such hinge, the supporting part, without rotating with respect to the holder part which holds the door, can move up-and-down with respect to the holder part. That is, the supporting part, in association with the rotation of the door, rotates together with the holder part which holds the door, but does not rotate with respect to the holder part. Thus, according to such hinge, an unintentional shift of the height of the door to the up-and-down direction together with the rotation of the door can be prevented.

DESCRIPTION OF EMBODIMENTS

Figure 1:
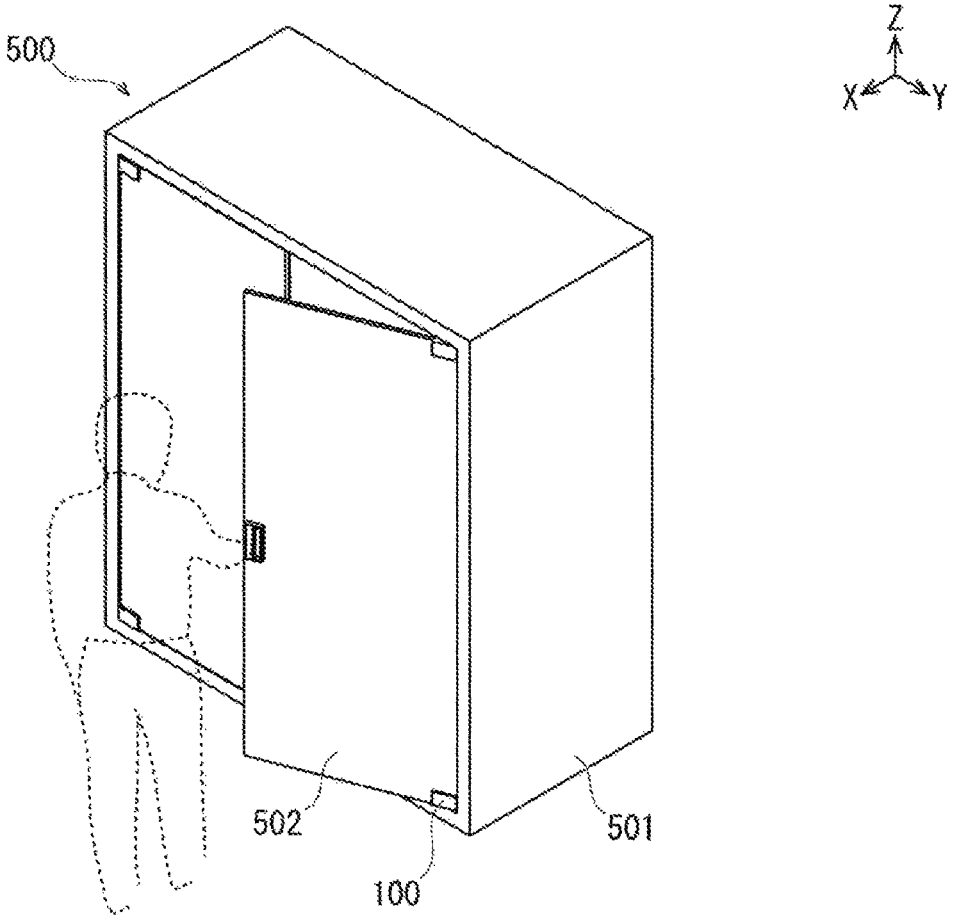
FIG. 1 shown a perspective view showing schematically a large sized cabinet to which the hinge of embodiment for a door is used.

Hereinafter, embodiments of the present invention will be described with reference to attached drawings. In the drawings, the same members are provided with the same reference signs and redundant description will be omitted.

In each figure, the arrows represented by X, Y and Z are used to indicate orientation of a hinge 100. A direction of the arrow represented by X indicates a thickness (depth) direction X of the hinge 100. A direction of the arrow represented by Y indicates a lateral width direction Y of the hinge 100. A direction of the arrow represented by Z indicates a height direction Z of the hinge 100.

Figure 7A:
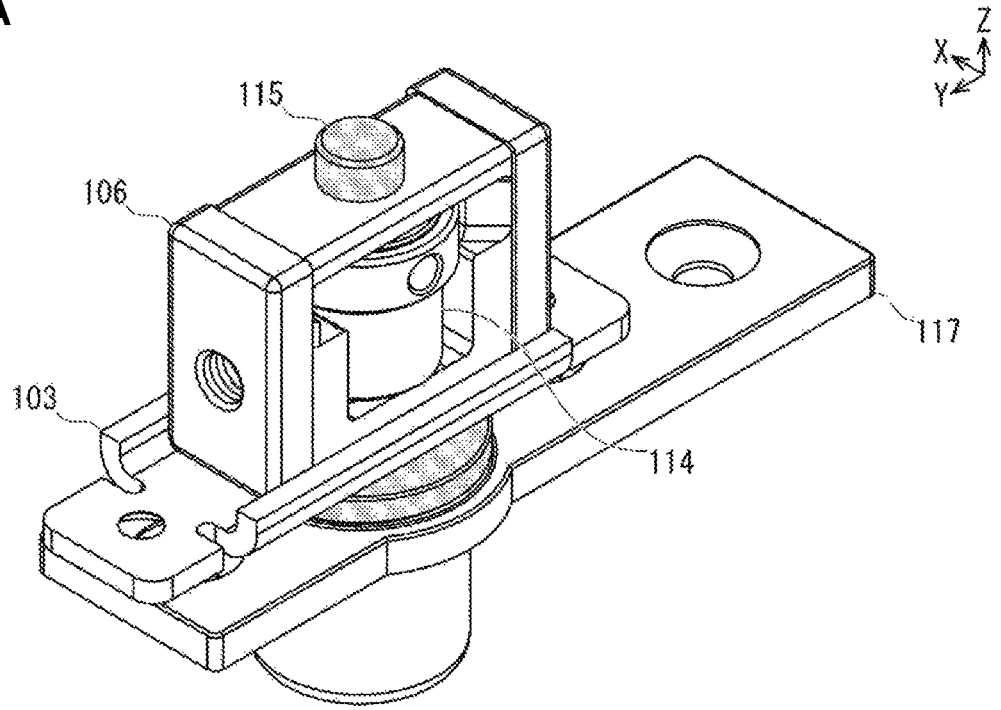
FIG. 7A shows a main part of a method for adjusting a height of a hinge with a state where the height of the hinge is adjusted at the minimum.
Figure 7B:
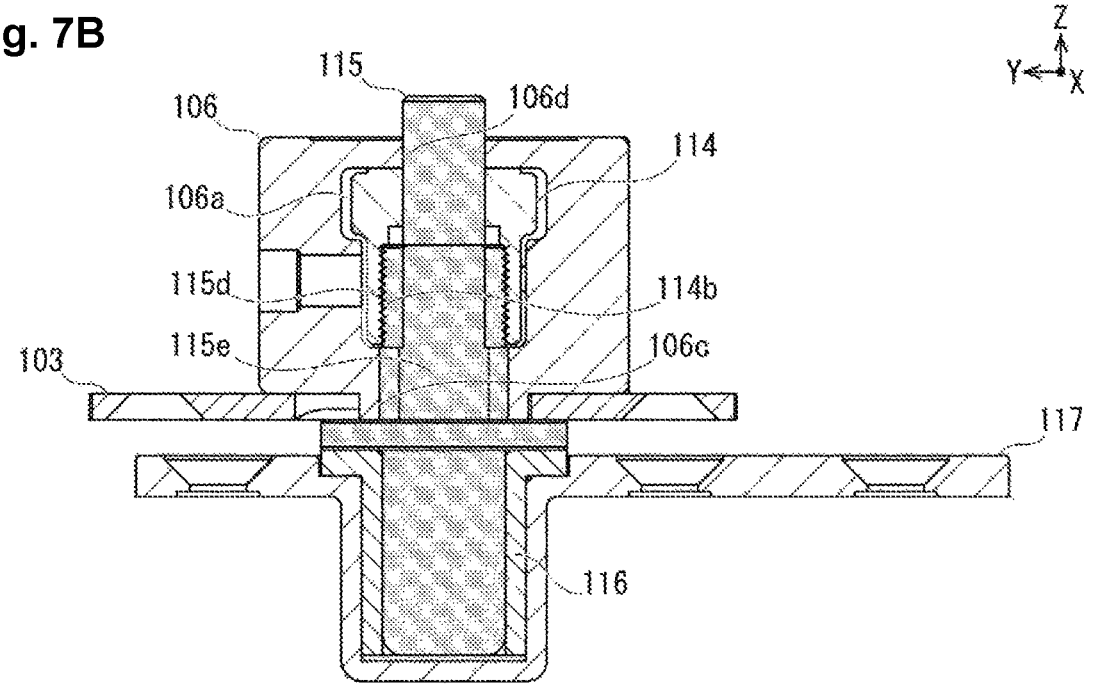
FIG. 7B shows a side view showing the state of FIG. 7A in a cross section.

With reference to FIG. 7B, when described generally, the hinge 100 according to the embodiment is the hinge 100 for rotatably supporting a door 502 and comprises a holder part (front side plate 101 and a backside plate 111 and the like) and for holding the door 502, a supporting part (rotation shaft 115) having a screw on an outer circumference (screw thread 115*d*) and for rotatably supporting the holder part from below, a rotation part (up-and-down adjustment ring 114) having a screw on an inner circumference (screw groove 114*b*) and for rotatably connecting to the screw thread 115*d* of the rotation part 115, a first regulation part (lower part through hole 106*c* having a non-circular shape of a left-and-right adjustment segment 106) disposed to the holder part and for regulating rotation of the rotation shaft 115 with respect to the supporting part, and a second regulating part (narrow receptacle part 106*a* along the up-and-down direction of the left-and-right adjustment segment 106) disposed to the holder part and for regulating up-and-down movement of the adjustment ring 114 with respect to the holding part along an upper-and-lower direction.

(Configuration of Hinge 100)

With reference to FIGS. 1 to 6B, the configuration of the hinge 100 will be described.

Figure 2A:
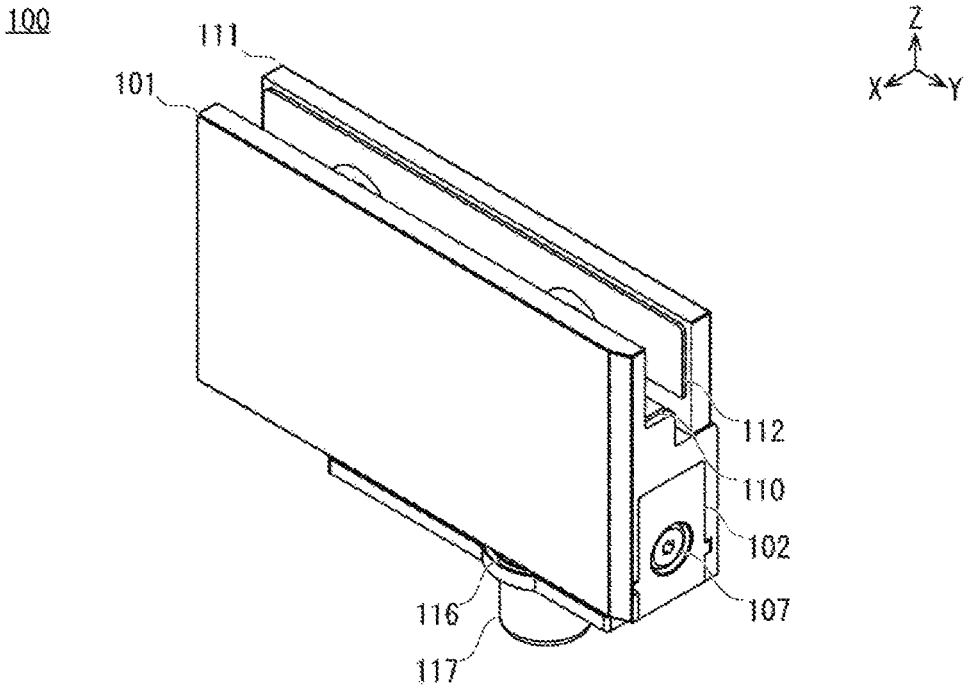
FIG. 2A shows a perspective view of a hinge illustrated from a front side.
Figure 2B:
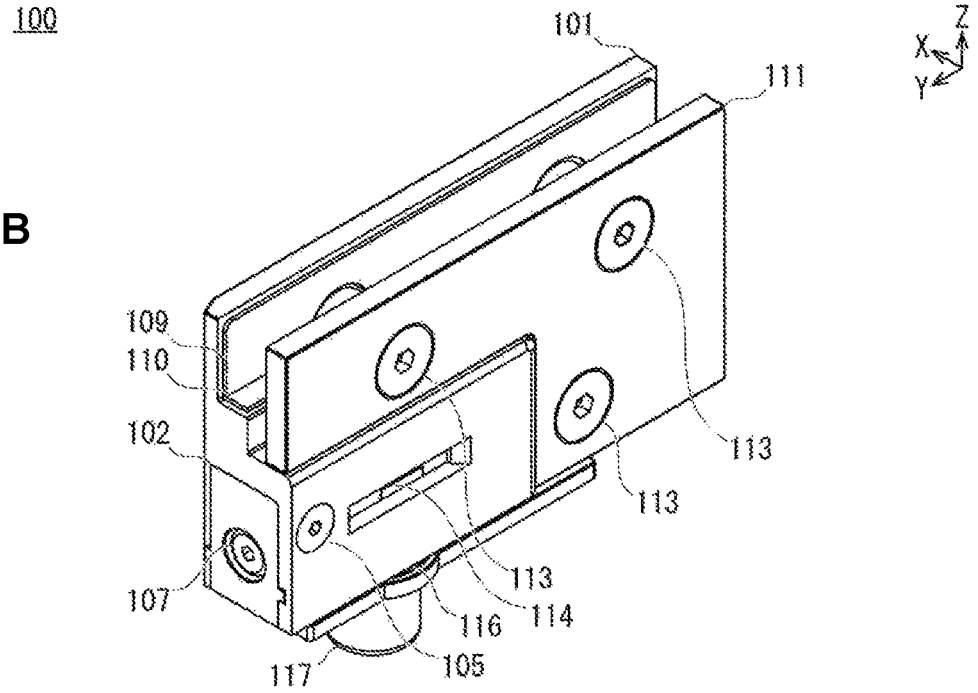
FIG. 2B shows a perspective view of a hinge illustrated from a rear side.
Figure 3:
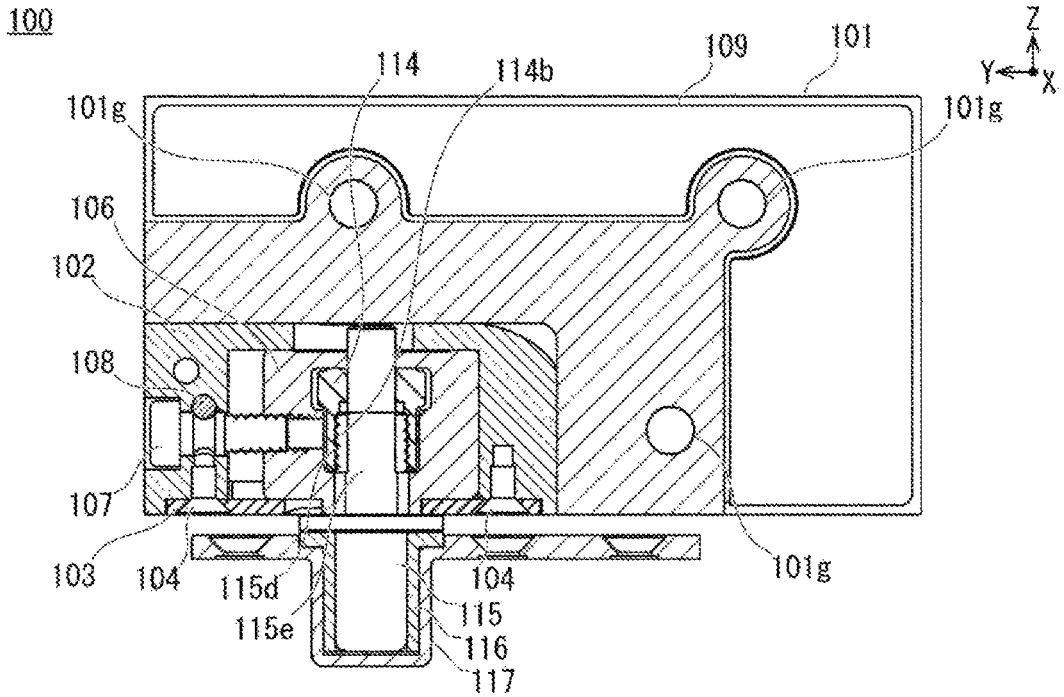
FIG. 3 shows a side view of a hinge illustrated in a cross section along one vertical plane (lateral width direction Y and height direction Z).
Figure 4:
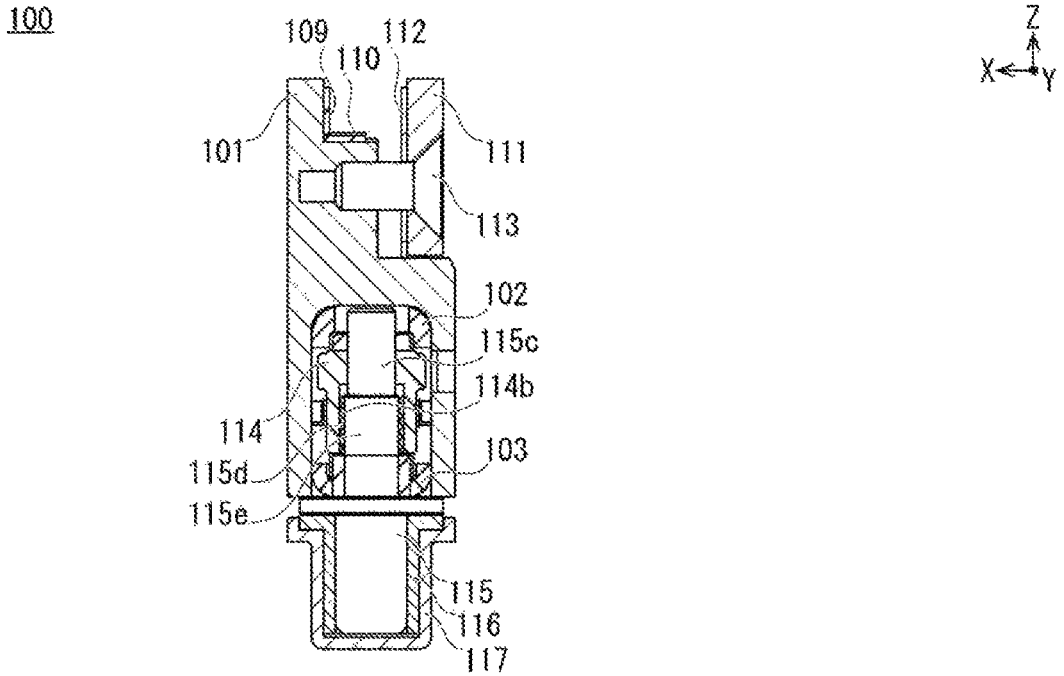
FIG. 4 shows a side view of a hinge illustrated in a cross section along another vertical plane (thickness direction X and height direction Z).
Figure 5A:
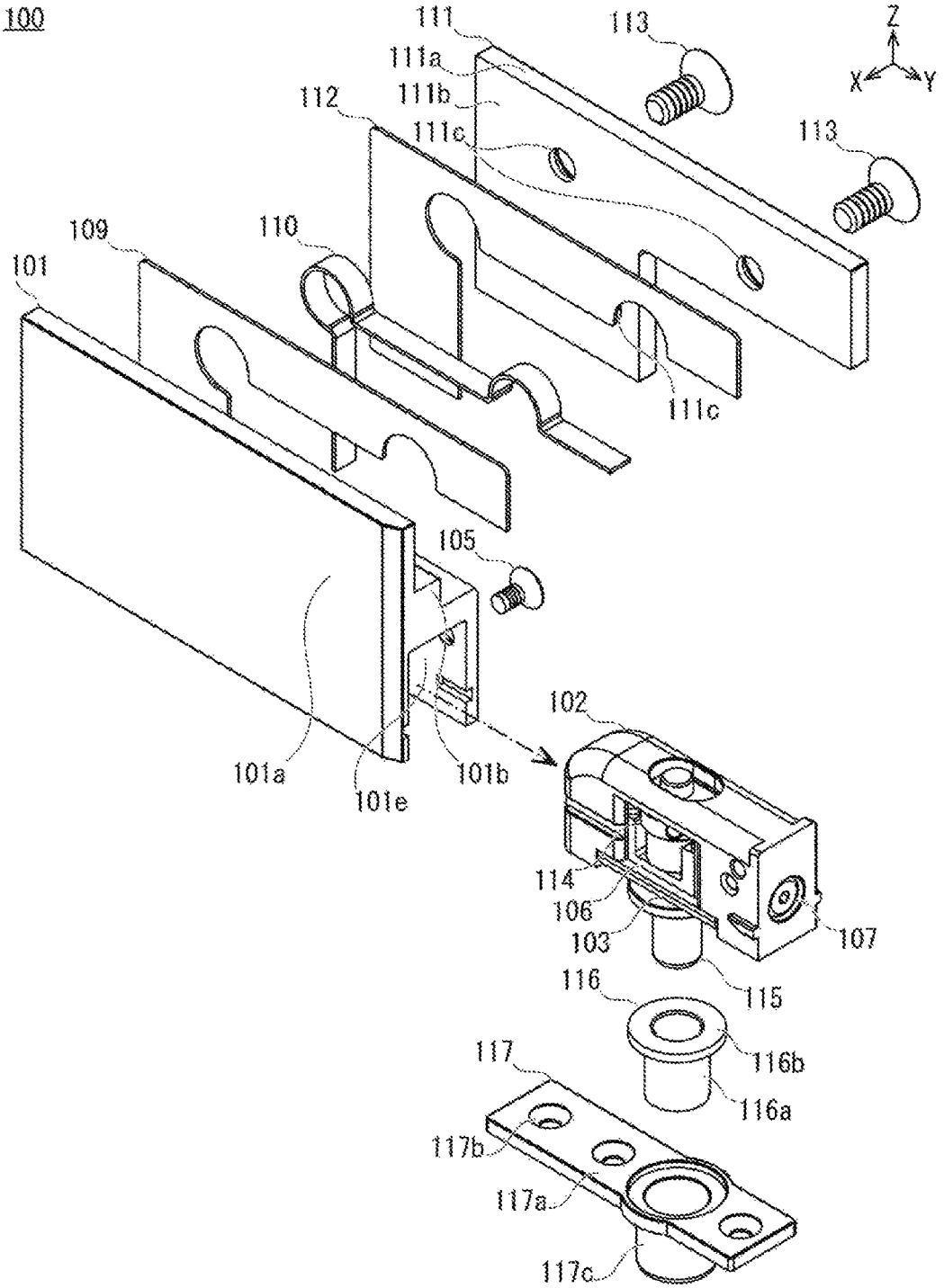
FIG. 5A shows a perspective view of a hinge partially exploded and illustrated from a front side.
Figure 5B:
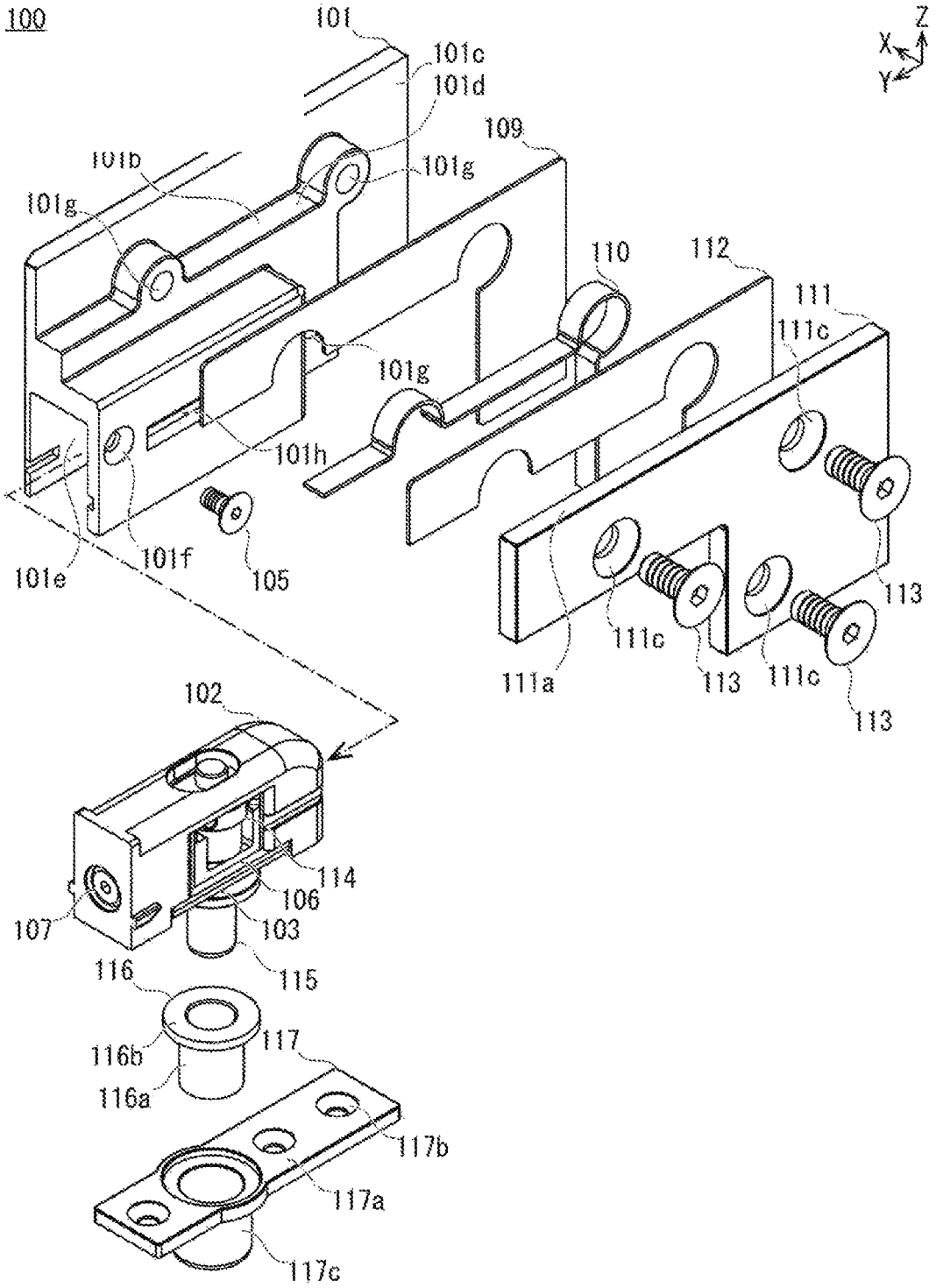
FIG. 5B shows a perspective view of the hinge partially exploded and illustrated from a backside.
Figure 6A:
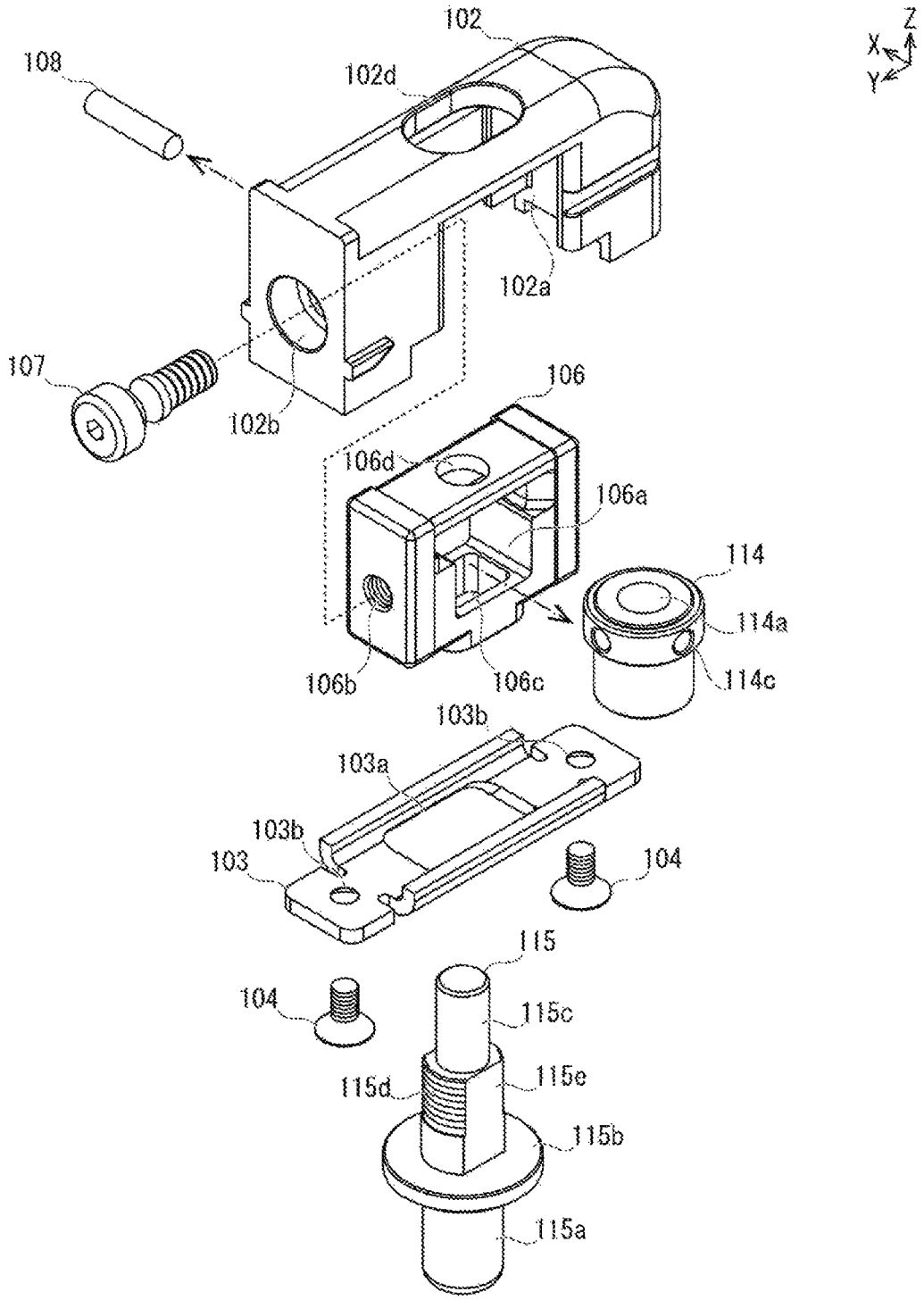
FIG. 6A shows a perspective view of an exploded principal part of a hinge illustrated from above at a backside.
Figure 6B:
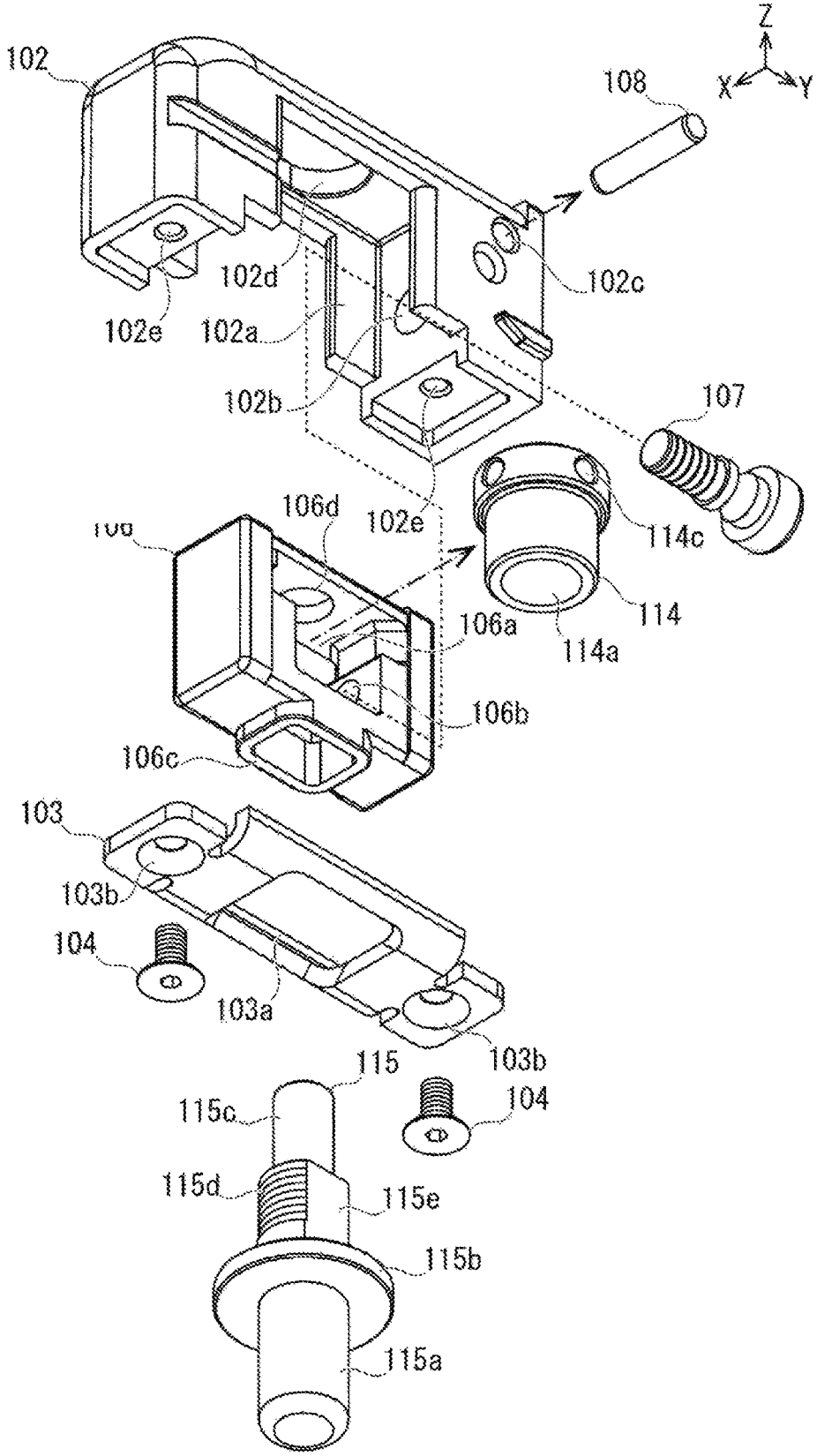
FIG. 6B shows a perspective view of an exploded principal part of a hinge illustrated from below at a backside.

FIG. 1 shows a perspective view illustrating schematically a large sized cabinet 500 to which a hinge 100 of an embodiment is used to a door 502. FIG. 2A shows a perspective view of the hinge 100 viewed from the front side thereof. FIG. 2B shows a perspective view of the hinge 100 viewed from the backside thereof. FIG. 3 shows a side view showing the hinge 100 in a cross section along one vertical plane (a lateral width direction Y and a height direction Z). FIG. 4 shows a side view showing the hinge 100 in a cross section along another vertical plane (a thickness direction X and the height direction Z). FIG. 5A shows a perspective view of a hinge partially exploded and illustrated from the front side. FIG. 5B shows a perspective view of the hinge partially exploded partially and illustrated from the backside. FIG. 6A shows a perspective view of an exploded principal part of a hinge illustrated from above at the backside. FIG. 6B shows a perspective view of an exploded principal part of a hinge illustrated from below at the backside.

The hinge 100, as shown in FIG. 1, for example, is one that is disposed on a housing 501 of the large sized cabinet 500 for rotatably holding the door 502 Although an explanation is provided with assuming that the hinge 100 is an R-hinge (right hanging support) which has a joint at a right side at a frontally opened state, the explanation may be applied to a L-hinge (left hanging member) which has a joint at left side. The hinge 100 holds rotatably the door 502 from a lower side. A front side plate 101—a washer 117 composing the hinge 100 will be explained in turn.

The front side plate 101 is shown in FIGS. 2A to 5B, and is one that holds the door 502 from the lower side at one side (front side). The front side plate 101 includes a base part 101*a* opposite to the door 502 and a protrusion part 101*b* protruding from the base part 101*a* toward a lower direction of the door 502. The front side plate 101 holds the door 502 through a front packing 109 and a lower packing 110 by a lateral side 101*c* of the base part 101*a* and a placement face 101*d* corresponding to an upper face of the protrusion part 101*b*. To the protrusion part 101*b*, a receptacle room 101*e* is formed so as to receive a box 102 for the left-and-right adjustment segment. The receptacle room 101*e* supports an opposing end side (the side where a left-and right adjustment screw 107 is not present.) along the lateral width direction Y of the box 102 for the left-and-right adjustment segment so as to receive without rattling of the box 102 for the left-and-right adjustment segment. The protrusion part 101*b* is formed with a screw hole 101*f* for inserting a second hexagon socket countersunk head screw 105 toward the receptacle room 101*e* and three screw holes 101*g* for screwing third hexagon socket countersunk head screws 113. The protrusion part 101*b* is formed with a long hole 101*h* passing through the receptacle room 101*e* while having an elongated size along the lateral width direction Y. Through the long hole 101*h* formed to the protrusion part 101*b*, an up-and-down adjustment ring 114 disposed inside is made rotated. The front side plate 101, for example, may be consisted of yellow copper (brass).

The box 102 for the left-and right adjustment segment is shown in FIG. 2A-FIG. 6B and is one that movably receives the left-and-right adjustment segment 106 along the lateral width direction Y. The box 102 for the left-and-right adjustment segment is formed with a rectangular receptacle room 102*a* for receiving the left-and-right adjustment segment 106 movably along the lateral width direction Y. The receptacle room 102*a* is configured by cutting a lower part to a center part of the box 102 for the left-and-right adjustment segment. The box 102 for the left-and-right adjustment segment is formed with a through hole 102*b* which passes through the receptacle room 102*a* at the lateral wall and into which the left-and-right adjustment screw 107 is inserted and a through hole 102*c* which passes through to the through hole 102*b* at the lateral wall crossing at right angles with a face having the through hole 102*b* and into which a caulking pin 108 is inserted. The box 102 for the left-and-right adjustment segment is formed with a long hole 102*d* passing through to an upper part from the receptacle room 102*a* and having an elongated size along the lateral width direction Y for allowing the rotation shaft 115 to insert rotatably. The box 102 for the left-and-right adjustment segment is formed with a pair of screw holes 102*e* for screwing a first hexagon socket countersunk head screw 104 at both ends of a lower part. The box 102 for the left-and-right adjustment segment, for example, may be consisted of yellow copper (brass).

A back cover 103 is shown in FIG. 3-FIG. 6B and is one that covers from below the box 102 for the left-and-right adjustment segment 106 receiving the left-and-right adjustment segment 106. The back cover 103 is formed with a long hole 103*a* with an elongated size along the lateral width direction Y for inserting rotatably the rotation shaft 115 and a pair of through holes 103*b* for inserting the first hexagon socket countersunk head screws 104. The back cover, for example, may be consisted of a cold rolled steel plate.

The first hexagon socket countersunk head screw 104 is shown in FIG. 6A and FIG. 6B and is one that fixes the back cover 103 to the box 102 for the left-and-right adjustment segment. The first hexagon socket countersunk head screws 104 are inserted into the pair of the through holes 103*b* of the back cover 103 and are screwed to the pair of screw holes 102*e* of the box 102 for the left-and-right adjustment segment.

The second hexagon socket countersunk head screw 105 is shown in FIG. 2B, FIG. 5A and FIG. 5B and is one that fixes the box 102 for the left-and-right adjustment segment to the front side plate 101. The second hexagon socket countersunk head screw 105 fixes the box 120 for the left-and-right adjustment segment through a screw hole 101*f* of the front side plate 101.

The left-and-right adjustment segment 106 is shown in FIG. 3-FIG. 6B and is one that adjusts a position of the door 502 held by the front plate 101 along the lateral width direction Y. The left-and-right adjustment segment 106 is received in the receptacle room 102*a* in the box 102 for the left-and-right adjustment segment. The left-and-right adjustment segment 106 is formed with a receptacle part 106*a* for receiving rotatably the up-and-down adjustment ring 114. The receptacle part 106*a* contacts to a upper end of the up-and-down adjustment ring 114. The left-and-right adjustment segment 106 is formed with a screw hole 106*b* for screwing the left-and right adjustment screw 107 to the lateral wall. The left-and-right adjustment segment 106 is formed with a lower part through hole 106*c* having a non-circular shape for inserting movably the rotation shaft 115 up-and-down to its lower part. The non-circular shape may be, for example, a rectangular, trapezoid, or elliptic shape and the like, and means herein the shape except for the perfect circle. The left-and-right adjustment segment 106 is formed with an upper part through hole 106*d* for inserting movably the rotation shaft 115 up-and-down to its upper part. The left-and-right adjustment segment 106 may, for example, be consisted of yellow copper (brass).

The left-and-right adjustment screw 107 is shown in FIG. 2A-FIG. 6B and is one that makes the left-and-right adjustment segment 106 move along the lateral width direction Y. A left-and-right adjustment screw 107 makes, without moving the rotation shaft 115, the front side plate 101 and the backside plate 111 and the like move along the lateral width direction Y of the door 502. The left-and-right adjustment screw 107 is connected to the screw hole 106*b* of the left-and-light adjustment segment 106 under the condition that the left-and right adjustment screw 107 is inserted in the thought hole 102*b* of the box 102 for the left-and-right adjustment segment. When left-and-right adjustment screw 107 is rotated, the left-and-right adjustment segment 106 moves left and right along the lateral width direction Y under the condition that the left-and-right adjustment segment 106 contacts with an inner wall of the box 102 of the left-and-right adjustment segment. The left-and-right adjustment screw 107 is not inserted in the rotation shaft 115 (does not pass through the rotation shaft 115).

The caulking pin 108 is shown in FIG. 6A and FIG. 6B and is one that prevents the left-and-right adjustment screw 107 from falling down from the box 102 for the left-and-right adjustment segment and also prevents the left-and-right adjustment screw 107 from moving along the lateral width direction Y with respect to the box 102 for the left-and-right adjustment segment. The caulking pin 108 is consisted of an elongated thin cylinder shape and is inserted into the through hole 102*c* of the box 102 for the left-and-right adjustment segment. The caulking pin 108 contacts with a concave part formed along a circumference direction at a base end side of the left-and-right adjustment screw 107. The caulking pin 108 does not hinder rotation of the left-and-right adjustment screw 107. The caulking pin 108 may, for example, be consisted of stainless steel.

The front side packing 109 is shown in FIG. 2B-FIG. 5B and is one that protects the door 502 from the side of the front plate 101. The front side packing 109 is disposed between the front side plate 101 and the door 502. The front side packing 109 is consisted of a shape conformed to a part of a lateral side 101*c* of the front side plate 101 and is thinner sufficiently than the front side plate 101. The front side packing 109 may be, for example, consisted of chloroprene rubber.

The lower side packing 110 is shown in FIG. 2A-FIG. 5B and is one that protects a lower side of the door 502. The lower side packing 110 is disposed between the placement surface 101*d* of the front side plate 101 and the door 502. The lower side packing 110 is consisted of a shape conformed to a part of the placement surface 101 of the front side plate 101 and is thinner sufficiently than the front side plate 101. The lower side packing 110 may be, for example, consisted of chloroprene rubber as well as the front side packing 109.

The backside plate 111 is opposite to the front side plate 101 and is one that holds the door 502 from below at one side (backside). The backside plate 111 has a base part 111*a* opposite to the door 502. The backside plate 111 holds the door 502 by a lateral face 111*b* of the base part 111*a* through a backside packing 112. The base part 111*a* is formed with three through holes 111*c* for inserting the third hexagon socket countersunk head screws 113. The backside plate 111 may be, for example, consisted of yellow copper (brass) as well as the front side plate 101.

The backside packing 112 is shown in FIG. 2A-FIG. 4-FIG. 5B and is one that protects the door 502 from the side of the backside plate 111. The backside packing 112 is disposed between the backside plate 111 and the door 502. The backside packing 112 is consisted of the shape same with the front side packing 109 and is thinner sufficiently than the backside plate 111. The backside packing 112 may be, for example, consisted of chloroprene rubber as well as the front side packing 109.

The third hexagon socket countersunk head screw 113 is shown in FIG. 2B, FIG. 4-FIG. 5B and is one that screws the front side plate 101 to the backside plate 111. Three third hexagon socket countersunk head screws 113 are inserted into three through holes 111*c* disposed to the backside plate 111 and are screwed to the screw holes 101*g* disposed to the front side plate 101.

The up-and-down adjustment ring 114 is shown in FIG. 3-FIG. 6B and is one that makes the rotation shaft 115 move up and down (height direction Z) without the rotation. The up-and-down adjustment ring 114 is inserted rotatably into the receptacle part 106*a* of the left-and-right adjustment segment 106 under the condition that there are slight gaps along the height direction Z. The up-and-down adjustment ring 114 is consisted of a cylinder shape and is formed with an inserting hole 114*a* for allowing insertion of an upper part of the rotation shaft 115 and a screw groove 114*b* positioned at a lower part of the insertion hole 114*a* and connected to the screw groove 115*d* of the rotation shaft 115. The up-and-down adjustment ring 114 rotates in the receptacle part 106*a* of the left-and-right adjustment segment 106 without moving up-and-down. As the result, the rotation shaft 115 connected to the up-and-down ring 114 moves up-and-down without the rotation. The up-and-down adjustment ring 114 is formed with a put-in hole 114*c* for putting-in a tool (for example, a metal rod having a cylinder shape) for causing rotation of the up- and down adjustment ring 114 on the outer circumference. The up-and-down ring 114 has a plurality of the put-in holes 114*c* along a circumferential direction while passing through to the insertion hole 114*a*. The up-and-down adjustment ring 114 may, for example, be consisted of yellow copper (grass). The metal rod put in the put-in hole 114*c* can be inserted sufficiently so as to contact with a small diameter part on which the screw groove 115*d* is not formed in an upper support pole 115*c* of the rotation shaft 115, and hence, the up-and-down adjustment ring 114 can be rotated sufficiently in the state inserted deeply to the rotation shaft 115.

The rotation shaft 115 is shown in FIG. 2A-FIG. 6B and is one that supports rotatably the holder part (the front side plate 101 and the backside plate 111 and the like) from below. Furthermore, the rotation shaft 115 is one that, among members configuring the hinge 100, causes a member for holding the door 502 (front side plate 101 and the like) move up-and-down along the height direction Z. The rotation shaft 115, with bordered by the flange 115*b* having a disk shape, is formed with a lower support pole 115*a* having a cylinder shape with a smaller diameter than the flange 115*b* at the lower part and the upper support pole 115*c* having a cylinder shape with a smaller diameter than the flange 115*b* at the lower part. The lower support pole 115*a* of the rotation shaft 115 is inserted into a washer bush 116. The upper support pole 115*c* is formed to have a thicker base end part than a top part and the screw groove 115*c* is formed at the base end part. The upper support pole 115*c* has, at the part to which the screw groove 115*d* is formed, a notched face 115*e* with being cut so as to face opposite left and right along the height direction Z.

The washer bush 116 is shown in FIG. 2A-FIG. 5B and is one that supports rotatably the rotation shaft 115. The washer bush 116 is formed with a cylinder part 116*a* for receiving the lower part supporting rod 115*a* of the rotation shaft 115 and a flange 116*b* having a disk shape while protruding radially and outwardly from the upper end of the cylinder part 116*a*. The washer bush 116 may, for example, be consisted of polyacetal.

The washer 117 is shown in FIG. 2A-FIG. 5B and is one that fixes the washer bush 116 to the housing 501. The washer 117 is formed with a base part 117*a* having a long strip shape contacting with a housing 501 and a through hole 117*b* for inserting a flathead bolt (not shown) which passes through the base part 117*a* and screws to the housing 501, and a cylinder part 117*c* with hollowing below a part of the base part 117*a* for inserting the washer bush 116. The washer 117 may, for example, be consisted of yellow copper.

(Method for Adjustment of Hinge Height 100)

With reference to FIG. 7A-FIG. 8B, a method for adjusting the height of the hinge will be explained.

Figure 8A:
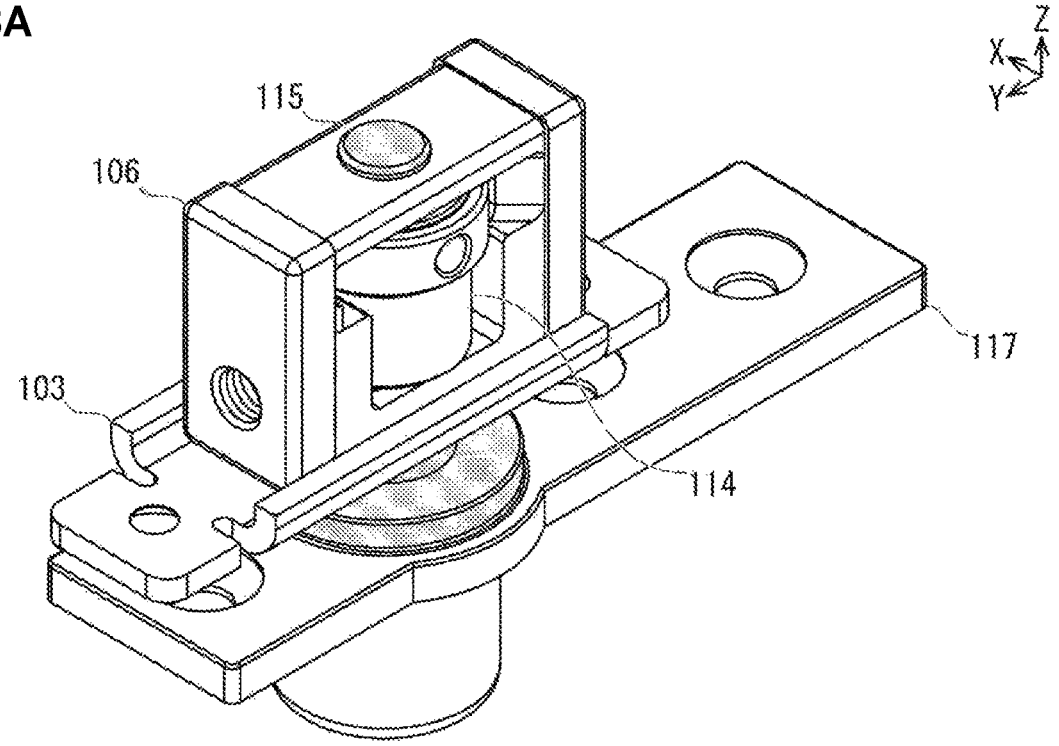
FIG. 8A shows a main part of a method for adjusting height of a hinge with a state where the height of the hinge is adjusted to the maximum.
Figure 8B:
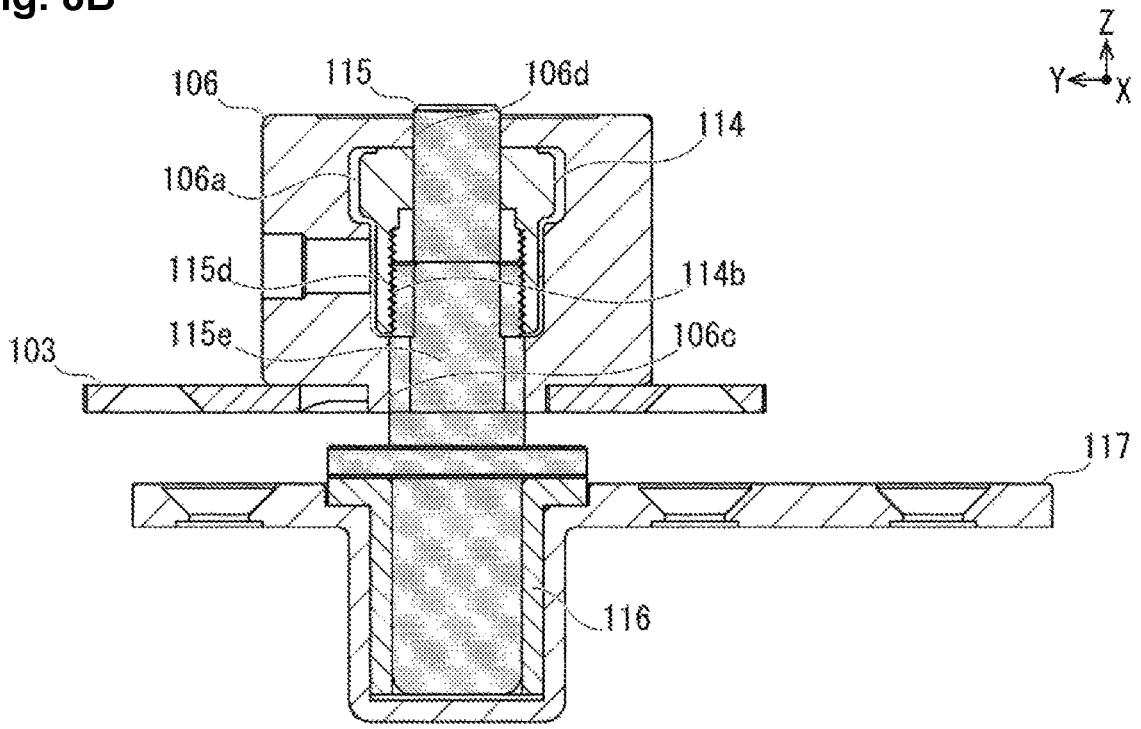
FIG. 8B shows a side view showing the state of FIG. 8A in a cross section.

FIG. 7A shows a main part of a method for adjusting a height of the hinge and illustrates a perspective view with a state where the height of the hinge 100 is adjusted at the minimum. FIG. 7B is a side view of the state shown in FIG. 7A as a cross section. FIG. 8A shows a main part of a method for adjusting the height of the hinge and illustrates a perspective view with a state where the height of the hinge 100 is adjusted to the maximum. FIG. 8B shows a side view showing the state of FIG. 8A in a cross section.

Among members configuring the hinge 100, the members for holding the door 502 (front side plate 101 and the like) can be brought from the state being the lowest position illustrated in FIG. 7A and FIG. 7B to the state being higher positions illustrated in FIG. 8A and FIG. 8B. When the up-and-down adjustment ring 114 is made rotate counterclockwise viewed from above, the up-and-down adjustment ring 114 does not move up and down along the height direction Z within the receptacle part 106*a* of the left-and-right adjustment segment 106 due to the slight gaps left above and below. Furthermore, the rotation shaft 115 is connected to the screw groove 114*b* of the up-and-down adjustment ring 114 but does not rotate because the notched face 115*e* disposed at the part of the screw groove 115*d* of the rotation shaft 115 is surface-contacted with the lower part through hole 106*c* having a non-circular shape of the left-and-right adjustment segment 106.

Therefore, when the up-and-down adjustment ring 114 is made rotate to a counterclockwise direction viewed from above, it elevates while rotating along the non-rotated rotation shaft 115. As the result, the left-and-right adjustment segment 106 receiving the up-and-down adjustment ring 114 is elevated likely that the left-and-right adjustment segment 106 is brought up by pushing from below by the up-and-down adjustment ring 114. That is, since the front side plate 101 and the like receives the left-and-right adjustment segment 106 through the box 102 for the left-and-right adjustment segment, they are elevated. As described above, the hinge 100 can adjust the door 502 to an optional height while making the members (front side plate 101 and the like) for holding the door 502 elevate.

On the other hand, among the members constructing the hinge 100, the member for holding the door 502 (front side plate 101 and the like) can be brought from the state being the higher position illustrated in FIG. 8A and FIG. 8B to the state being the lowest position illustrated in FIG. 7A and FIG. 7B. When the up-and-down adjustment ring 114 is made rotate to clockwise direction viewed from above, it goes down while rotating along the non-rotated rotation shaft 115. As the result, the left-and-right adjustment segment 106 receiving the up-and-down adjustment ring 114 goes down by pushing from above with the up-and-down adjustment ring 114. As described above, the hinge 100 can adjust the door 502 to an optional height while making the members for holding the door 502 (front side plate 101 and the like) go down.

(Function and Effect of Hinge 100)

The function and effect of the hinge described so far will be explained.

The hinge 100 is the hinge for rotatably supporting the door 502 and comprises a holder part for holding the door 502 (front side plate 101 and the backside plate 111 and the like), a supporting part having the screw (screw thread 115*d*) on the outer circumference and for supporting the holder part rotatably from below (rotation shaft 115), and a rotation part (up-and-down adjustment ring 114) having the screw (screw groove 114*b*) on the inner circumference and for connecting rotatably to the screw thread 115*d* of the rotation shaft 115, the first regulation part (lower part through hole 106*c* with the non-circular shape of the left-and-right adjustment segment 106) disposed to the holder part and for regulating the rotation of the rotation part 115 with respect to the holder part, and the second regulation part narrow receptacle part 106*a* along the up-and-down direction of the left-and-right adjustment segment 106) disposed to the holder part and for regulating movement of the up-and-down adjustment ring 114 in the up-and-down direction with respect to the holder part.

According to such hinge 100, the rotation shaft 115 can move up-and-down with respect to the holder part without rotating to the holder part holding the door 502. That is, the rotation shaft 115 rotates, with respect to the holder part, together with the holder part for holding the door 502 as the rotation of the door 502 but not rotates with respect to the holder part. Therefore, according to such hinge 100, the unexpected shift of the height of the door 502 to the up-and-down direction (the height direction Z), in association to the rotation of the door 502, may be prevented.

Therefore, according to such hinge 100, interference between the door 502 and a bottom face due to going down of the door 502 through the rotation of the rotation shaft 115 caused by its weight may be prevented.

According to such hinge 100, since the holder part can be made, without rotating the rotation shaft 115, to move up-and down, disturbance on working due to the rotation of the door 502 may be prevented.

According to such hinge 100, particularly, even in the case that the door 502 is large and heavy, without removing the door 502 from the holder part, the height of the door 502 can be adjusted easily.

According to such hinge 100, since the holder part for holding the door 502 and the rotation shaft 115 for supporting the holder part can be positioned coaxially, in the condition that the weight of the door 502 is well received by the rotation shaft 115, the height of the door 502 may be easily adjusted.

In the hinge 100, the first regulation part (left-and-right adjustment segment 106) preferably has the configuration in which the first regulation part includes the through hole (the lower through hole 106*c*) having the non-circular shape and for inserting the rotation shaft 115 and the part including the lower through hole 106*c* contacts with the outer face of the rotation shaft 115 (the notched face 115*e*), is preferred.

According to such hinge 100, by the above quite simple configuration, when the up-and-down adjustment ring 114 is made to rotate, the rotation shaft 115 can be regulated (prevented) to rotate with respect to the holder part.

In the hinge 100, The second regulation part (narrow receptacle part 106*a* above and below the left-and-right adjustment segment 106) preferably has the configuration in which the second regulation part includes the receptacle part 106*a* for inserting the up-and-down adjustment ring 114 and the receptacle part 106*a* contacts with the upper end of the up-and-down adjustment ring 114.

According to such hinge 100, by the quite simple configuration above, when the up-and-down adjustment ring 114 is made to rotate, the up-and-down movement of the up-and-down adjustment ring 114 with respect to the holder part may be restricted (protected).

The hinge 100 further includes preferably the adjustment member (the left-and-right adjustment screw 107) for making the holder part (the front side plate 101 and the backside plate 111 and the like) move along the lateral width direction Y of the door 502 and the left-and-right adjustment screw 107 extends preferably along the lateral width direction Y of the door 502 while not being inserted to the rotation shaft 115 standing up along the up-and-down direction (the height direction Z).

According to such hinge 100, when making the up-and-down adjustment ring 114 rotate, the rotation shaft 115 can move up-and-down without interfering with the left-and-right adjustment screw 107.

In the hinge 100, the holder part (the front side plate 101 and the backside plate 111 and the like) includes preferably the hole (long hole 101*h*) for exposing the up-and-down adjustment ring 114 outside.

According to such hinge 100, the up-and-down adjustment ring 114 can be easily made to rotate through the long hole 101*h* provided to the holder part (the front side plate 101 and the backside plate 111 and the like).

The present invention may not be restricted to the embodiments described above and various modifications may be possible based on features described in claims, and thus, such various modifications should be with in scope of the present invention.

The hinge 100 of the embodiments has been explained as the configuration that supports rotatably the door 502 from below, however, the configuration that supports rotatably the door 502 at the upper part and the lower part at the lateral side.

The present application is based on the Japanese Patent application No. 2017-050968 and the disclosure thereof is herein incorporated entirely as reference.

DESCRIPTION OF SIGNS

100 hinge, 101 front side plate (corresponding to holder part), 101*a* base part, 101*b* protrusion part, 101*c* lateral face, 101*d* placement face, 101*e* receptacle room, 101*f* screw hole, 101*g* screw hole, 101*h* long hole (corresponding to hole), 102 box for left-and-right adjustment segment, 102*a* receptacle room, 102*b* through hole, 102*c* through hole, 102*d* long hole, 102*e* screw hole, 103 back cover, 103*a* long hole, 103*b* through hole, 104 first hexagon socket countersunk head screw, 105 second hexagon socket countersunk head screw, 106 left-and-right adjustment segment, 106*a* receptacle part (corresponding to second regulation part), 106*b* screw hole, 106*c* lower part through hole (corresponding to first regulation part), 106*d* upper part through hole, 107 left-and-right adjustment screw (corresponding to adjustment member), 108 caulking pin, 109 front side packing, 110 lower packing, 111 backside plate (corresponding to holder part), 111*a* base part, 111*b* lateral side, 111*c* through hole, 112 backside packing, 113 third hexagon socket countersunk head screw, 114 up-and-down adjustment ring (corresponding to rotation part), 114*a* insertion hole, 114*b* screw groove, 114*c* put-in hole, 115 rotation shaft (corresponding to supporting part), 115*a* lower part supporting rod, 115*b* flange, 115*c* upper part supporting rod, 115*d* screw thread, 115*e* notched face (corresponding to outer face), 116 washer bush, 116*a* cylinder part, 116*b* flange, 117 washer, 117*a* base part, 117*b* through hole, 117*c* cylinder part, 500 large sized cabinet, 501 housing, 502 door, X thickness (depth) direction of hinge 100, Y lateral width direction of hinge 100, Z height direction of hinge 100

The invention claimed is:

1. A hinge for supporting rotatably a door comprising:

a holder part for holding a door;

a supporting part having a screw on an outer circumference and for supporting rotatably the holder part from below;

a rotation part having a screw on an inner circumference and for rotatably connecting to the screw of the supporting part and for rotating with respect to the holder part;

a first limitation part disposed to the holder part and for limiting rotation of the supporting part with respect to the holder part; and a second limitation part disposed to the holder part and for limiting movement of the rotation part in an up-and-down direction with respect to the holder part.

2. The hinge of claim 1, wherein the first limitation part comprises a part including a through hole for inserting the supporting part and having a non-circular shape; and the part including the through hole contacts with an outer face of the supporting part.

3. The hinge of claim 2, wherein the second limitation part comprises a receptacle part for inserting the rotation part; and the receptacle part contacts with an upper end of the rotation part.

4. The hinge of claim 1, wherein the second limitation part comprises a receptacle part for inserting the rotation part; and the receptacle part contacts with an upper end of the rotation part.

5. The hinge of claim 1, wherein the hinge further comprises an adjustment member for making the holder part move along a lateral width direction of the door while not making the supporting part move; and the adjustment member fixed to the holder part extends along the lateral width direction of the door and is not inserted to the supporting part standing up along an up-and-down direction.

6. The hinge of claim 1, wherein the hinge comprises a hole for exposing the rotation part outside.

* * * * *